US009723394B2

(12) United States Patent
Anderson et al.

(10) Patent No.: US 9,723,394 B2
(45) Date of Patent: Aug. 1, 2017

(54) HEADPHONE CLASPING DEVICE AND METHOD

(71) Applicant: Logitech Europe S.A, Lausanne (CH)

(72) Inventors: Jeffrey Anderson, Camas, WA (US); Matthew James Green, Vancouver, WA (US)

(73) Assignee: LOGITECH EUROPE S.A., Lausanne (CH)

( * ) Notice: Subject to any disclaimer, the term of this patent is extended or adjusted under 35 U.S.C. 154(b) by 5 days.

(21) Appl. No.: 14/660,102

(22) Filed: Mar. 17, 2015

(65) Prior Publication Data

US 2016/0057530 A1 Feb. 25, 2016

Related U.S. Application Data

(60) Provisional application No. 62/040,372, filed on Aug. 21, 2014.

(51) Int. Cl.
*H04R 1/10* (2006.01)

(52) U.S. Cl.
CPC ..... *H04R 1/1041* (2013.01)

(58) Field of Classification Search
CPC ..... H04R 1/1091
USPC ..... 381/384
See application file for complete search history.

(56) References Cited

U.S. PATENT DOCUMENTS

2008/0317274 A1* 12/2008 Kim ..... H04R 1/1058 381/370
2015/0195639 A1* 7/2015 Azmi ..... H04R 1/1058 381/74

* cited by examiner

*Primary Examiner* — Duc Nguyen
*Assistant Examiner* — Phan Le
(74) *Attorney, Agent, or Firm* — Patterson + Sheridan, LLP

(57) ABSTRACT

Embodiments of the present disclosure relate to a headphone or speaker assembly that contains two or more audio components that are configured to be magnetically coupled together by use of a complementary magnetic pole configuration in the headphone or speaker assembly to provide one or more useful functions. These useful functions may include elements that are able to sense that the two or more audio components are in contact with each other, or are at least proximate to each other, so that their audio playback capability can be suspended while they are in this unused state. Since the two or more audio components can be brought into contact with each other and be retained in this state by use of a magnetic force created between one or more magnetic components in each of the audio components, this design can provide a useful mechanism that will allow the headphone assembly to be easily retained on the user.

21 Claims, 8 Drawing Sheets

HEADPHONE CLASPING DEVICE AND METHOD

CROSS-REFERENCE TO RELATED APPLICATIONS

This application claims benefit of U.S. provisional patent application Ser. No. 62/040,372, filed Aug. 21, 2014 which is hereby incorporated herein by reference.

BACKGROUND

Field

Embodiments disclosed herein generally relate to a consumer electronic device that is configured to provide an audio output.

Description of the Related Art

Wireless speakers and wireless headphones allow users to be un-tethered to a video, gaming or music playing platform. Wireless headphones are particularly popular among video game players, since a player will not become entangled in an interconnecting cord, which connects the headphones to the gaming platform, while the player is playing the video game. The state-of-the-art wireless speakers and headphones are powered by batteries that have a finite lifetime before they need to be recharged or replaced. Therefore, most consumer electronics manufacturers have been working on ways to improve battery lifetimes and methods of reducing unnecessary power loss in these battery powered devices. However, conventional wireless headphones in the market place today typically continue to play after they are removed from a user's ear, unless the user remembers to switch the headphones to a "sleep" or "off" state. The action of continually playing audio information after the headphones have been removed from the user's ear(s) wastes the energy stored in the batteries, thus needlessly shortening the useable life of the batteries and use of the wireless headphones. The need to replace or recharge the headphone's batteries is an inconvenience to the user, since it can be costly during periods of high use, it may require the headphones to be unusable for a significant amount of time while they are being recharged and/or lead to a significant amount of environmentally hazardous waste that needs to be recycled.

Also, in the case where the wireless headphones are wireless earbuds, it is common to string the part of the earbuds that is inserted into the user's ears together such that they are tethered to the user so that they will not be easily lost by the user. However, the strung earbuds are typically not anchored to the user for comfort and complexity reasons, so it is not uncommon for these designs to become separated from the user from time to time.

Therefore, there is a need for wireless headphones that are able to be easily and securely retained on the user and have a mechanism that can automatically put the wireless headphones into a "sleep" or "off" mode when they are not in use.

SUMMARY

Embodiments of the present disclosure relate to a headphone or speaker assembly that contains audio components that are configured to be magnetically coupled together by use of a complementary magnetic pole configuration in the headphone or speaker assembly. The magnetically coupling of the audio components can be used to provide information to at least one of the audio components so that one or more useful control functions can be performed on at least one of the audio components. These useful control functions may include elements that are able to sense that the audio components are in contact with each other, or are at least proximate to each other, so that their audio playback capability can be suspended while they are in this unused state.

Embodiments of the present disclosure relate to an audio device, comprising a first audio component capable of generating an acoustic output from signals received through a communication link, wherein the first audio component comprises a first mating surface and a first primary magnet that has a north pole and a south pole that are oriented in first orientation relative to the first mating surface, and a second audio component capable of generating an acoustic output from signals received through a communication link, wherein the second audio component comprises a second mating surface and a second primary magnet that has a north pole and a south pole that are oriented in a second orientation relative to the second mating surface, and the second orientation is opposite to the first orientation. When the first and the second mating surfaces are positioned proximate to each other, the first and the second mating surfaces are attracted to each other based on the orientation of the first primary magnet and the second primary magnet.

Embodiments of the present disclosure may also relate to a method of generating an acoustic output from an audio device, comprising generating a first acoustic output from a first speaker disposed in a first audio component, wherein the first speaker comprises a first primary magnet that has a north pole and a south pole that are oriented in a first orientation relative to a front surface, generating a second acoustic output from a second speaker disposed in a second audio component, wherein the second speaker comprises a second primary magnet that has a north pole and a south pole that are oriented in a second orientation relative to a front surface, and the second orientation is opposite to the first orientation, and generating a holding force between the first audio component and the second audio component due to an attraction provided by the first primary magnet and the second primary magnet.

BRIEF DESCRIPTION OF THE DRAWINGS

So that the manner in which the above recited features of the disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

Figure 1A:
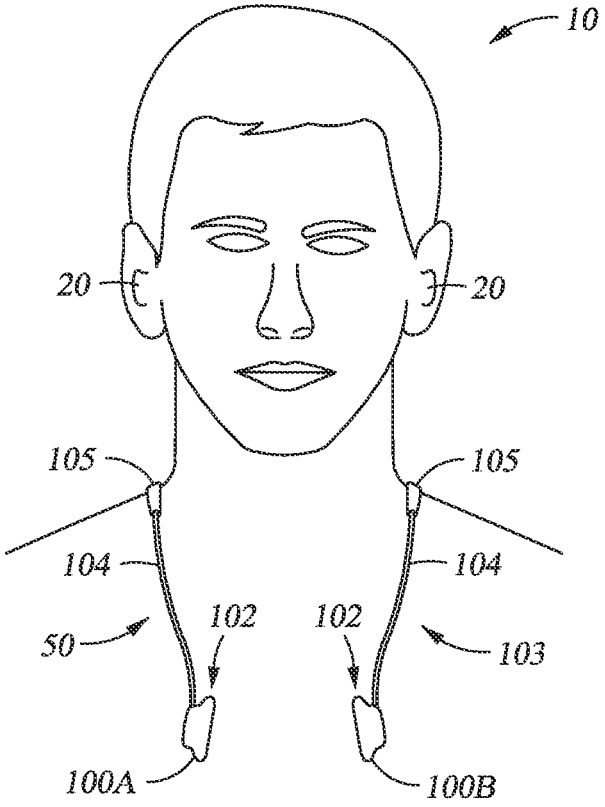
FIGS. 1A-1B are conceptual diagrams illustrating a wireless headphone system disposed on a user according to embodiments of the present disclosure.

To facilitate understanding, identical reference numerals have been used, where possible, to designate identical elements that are common to the figures. It is contemplated that elements disclosed in one embodiment may be beneficially utilized on other embodiments without specific recitation. The drawings referred to here should not be understood as being drawn to scale unless specifically noted. Also, the drawings are often simplified and details or components omitted for clarity of presentation and explanation. The drawings and discussion serve to explain principles discussed below, where like designations denote like elements.

DETAILED DESCRIPTION

In the following description, numerous specific details are set forth to provide a more thorough understanding of the present disclosure. However, it will be apparent to one of skill in the art that the present disclosure may be practiced without one or more of these specific details. In other instances, well-known features have not been described in order to avoid obscuring the present disclosure.

Embodiments of the present disclosure relate to a headphone or speaker assembly that contains two or more audio components that are configured to be magnetically coupled together by use of a complementary magnetic pole configuration in the headphone or speaker assembly to provide one or more useful functions. These useful functions may include elements that are able to sense that the two or more audio components are in contact with each other, or are at least proximate to each other, so that their audio playback capability can be suspended while they are in this unused state. By suspending the audio playback capability the battery, or power source, lifetime can be prolonged, since the audio components are not delivering audio content while they are not in use. Since the two or more audio components can be brought into contact with each other and be retained in this state by use of a magnetic force created between one or more magnetic components in each of the audio components, this design can also provide a useful mechanism that will allow the headphone assembly to be easily retained on a user.

The complementary magnetic pole configuration used in the headphone or speaker assemblies, which are described herein, remove the need for a separate and/or non-functional pair of magnets that are commonly found in conventional headphone and/or speaker assemblies today. Typically, conventional designs use the non-functional pair of magnets to hold multiple components together during device storage situations. In some conventional designs, pairs of magnets are typically placed in a non-functional region of various components in a headphone and/or speaker assembly to allow mating surfaces near these non-functional magnets in each separate component to be brought into contact with each other when the device is to be placed into storage. However, the use of these non-functional magnets, or magnets that do not help to generate an audio output by the headphone or speaker assembly, add to the cost and complexity of these conventional designs. The use of the non-functional magnets in the headphone or speaker assembly can also interfere with the magnetic fields generated by the functional magnetic components (e.g., speaker's primary magnet, driving coil, etc.) in the headphone or speaker assembly, and can thus undesirably alter the quality of the audio output generated by the headphone or speaker assembly. The various configurations described below remove the need for the non-functional magnetic components, and thus reduce the cost and complexity of the headphone or speaker assembly and improve the audio quality over other more conventional headphone or speaker designs.

Figure 1B:
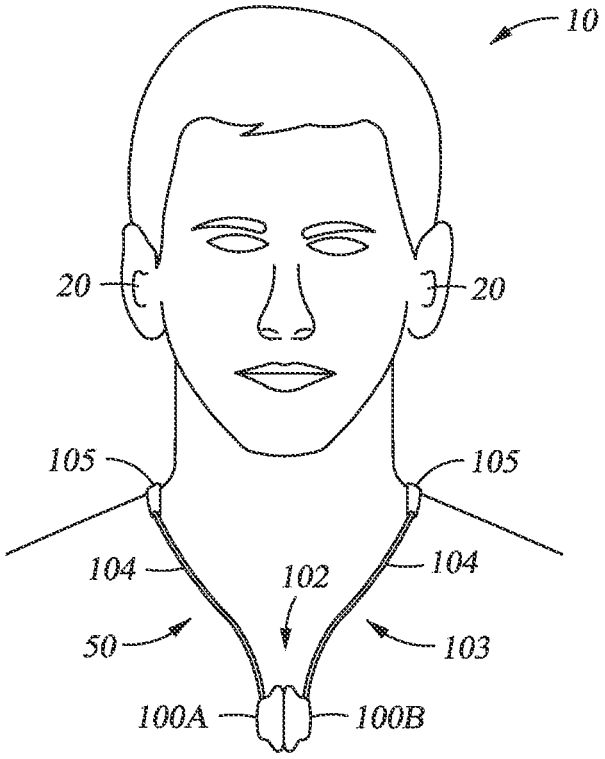

FIGS. 1A and 1B are conceptual diagrams that illustrate a wireless headphone system 50 according to one embodiment of the present disclosure. While a wireless headphone system is primarily described below, this configuration is not intended to limiting as to the scope of the disclosure provided herein, since other non-wireless headphone or speaker configurations may also benefit from the disclosure provided herein. The wireless headphone system 50 may include a first audio component 100A, a second audio component 100B and a connecting element 103 that can be positioned on a user 10. The connecting element 103 may include a band 105 and tethering elements 104 that are configured to be positioned around the user's neck, head, arm or other similar appendage. The connecting element 103 is typically a wire, cable, tube or other similar component that is positioned between the first and second audio components 100A, 100B, and is used to keep the first and second audio components 100A, 100B together. When the wireless headphone system 50 is in use the first audio component 100A and second audio component 100B are each configured to inserted or positioned into or onto the user's ear 20 to deliver audio content to the user. In one example, the first audio component 100A and second audio component 100B are wireless earbuds, earphones, in-ear monitors, or other similar devices.

In some embodiments, the wireless headphone system 50 need not include the connecting element 103. In this case, the magnetic attraction created by the complementary magnetic pole configuration, of the first and second audio components 100A and 100B, can be used to physically hold these audio components together during times of non-use, so that one or both of the audio components does not become inadvertently lost by the user. In either the connecting element containing or non-connecting element containing configurations of the wireless headphone system 50, the act of bring the audio components together can also be used to cause each audio component to go into an "off" or "sleep" state, as will be discussed further below.

FIG. 1A illustrates a configuration where the first and second audio components 100A, 100B are positioned a distance apart. This configuration may occur soon after the user has removed the first and second audio components 100A, 100B from their ears. FIG. 1B illustrates a configuration where the first and second audio components 100A, 100B are in contact with each other due to a magnetic attraction provided by one or more components found in one or more of the audio components 100A, 100B. The configuration illustrated in FIG. 1B may occur soon after the first and second audio components 100A, 100B have been position in a spaced apart relationship, as shown in FIG. 1A. Thus, the magnetic components in the first and the second audio components 100A, 100B cause the mating surfaces 102 of each audio component to be brought together to form a closed loop around the user's neck, head or other appendage (FIG. 1B) by use of the magnetic components in the audio components 100A, 100B and the connecting element 103.

Figure 2A:
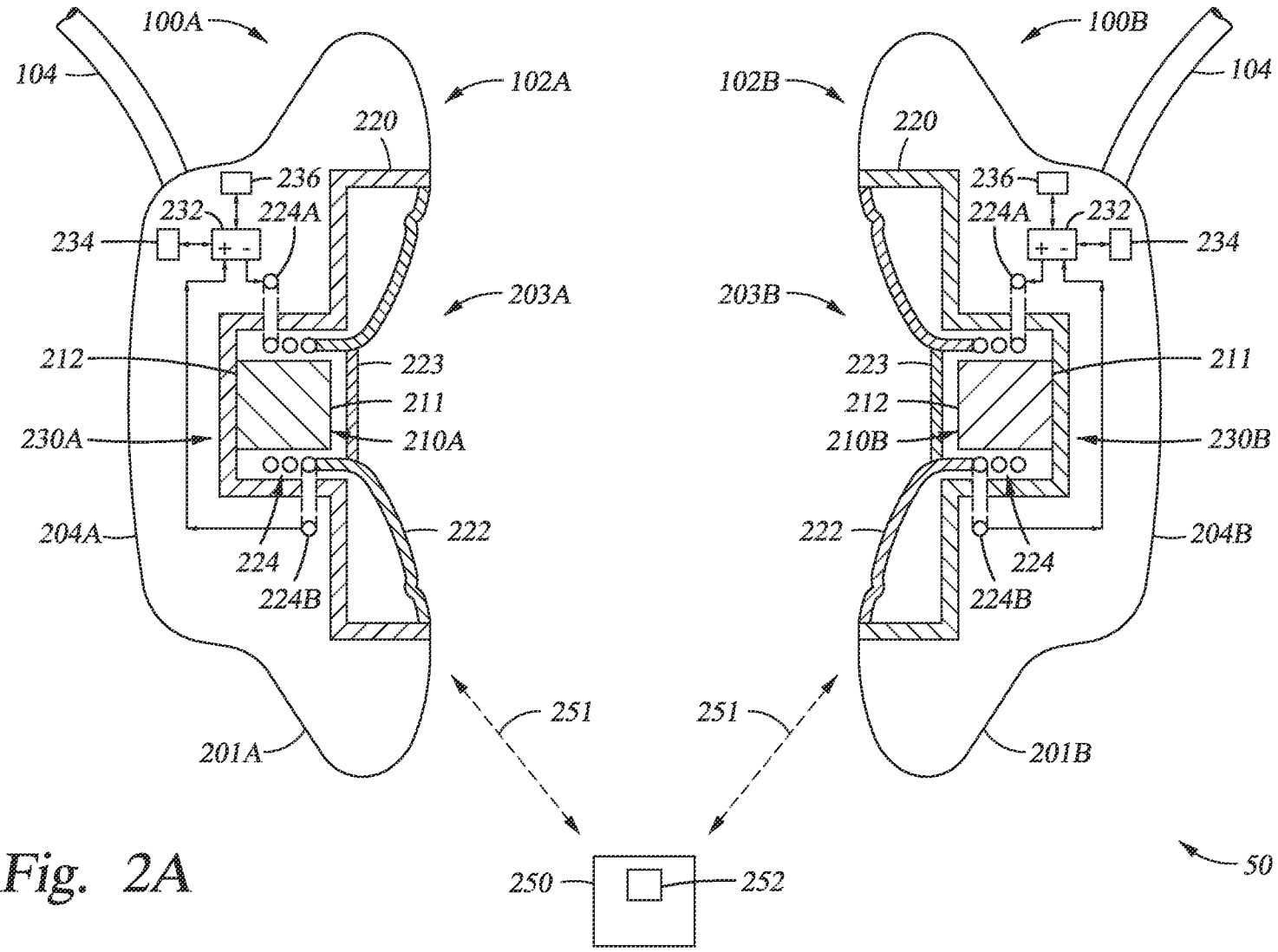
FIG. 2A is a schematic cross-sectional view of audio components in a wireless headphone system according to one embodiment of the present disclosure.
Figure 4:
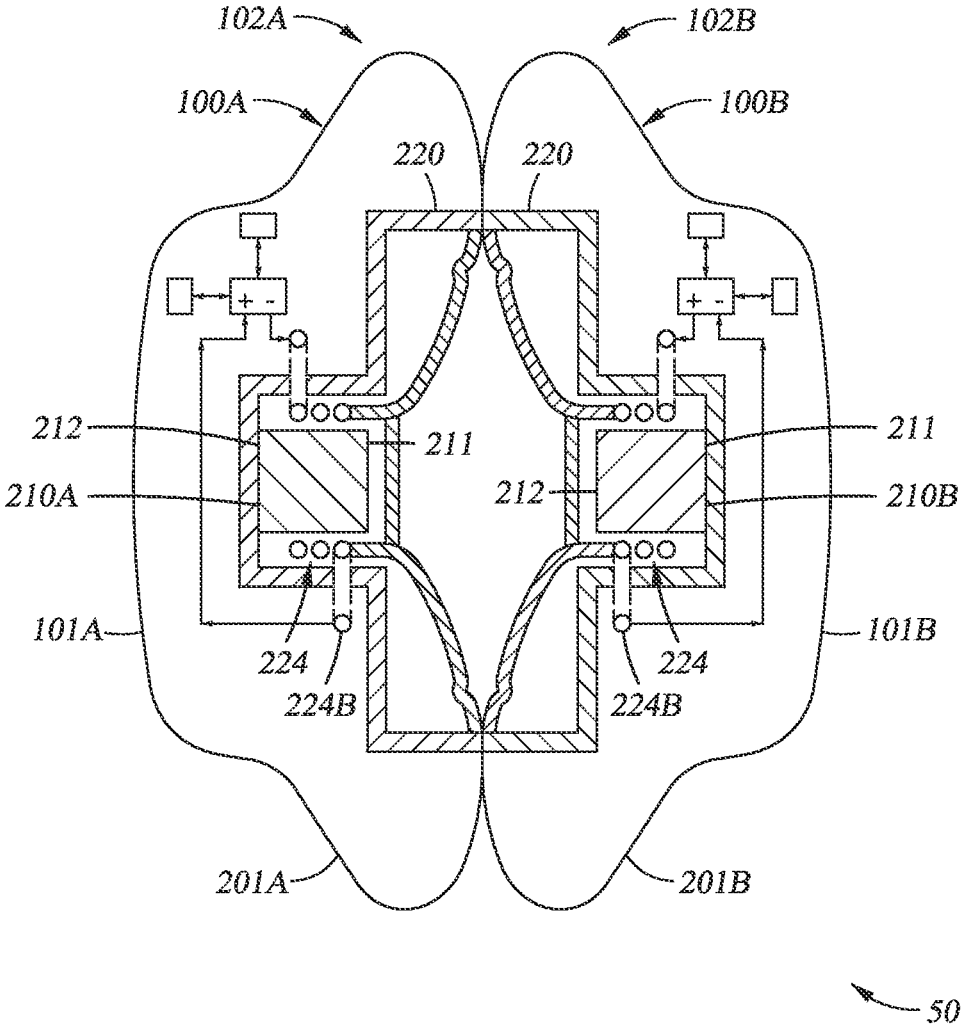
FIG. 4 is a schematic cross-sectional view of audio components in a wireless headphone system according to one embodiment of the present disclosure.
Figure 5:
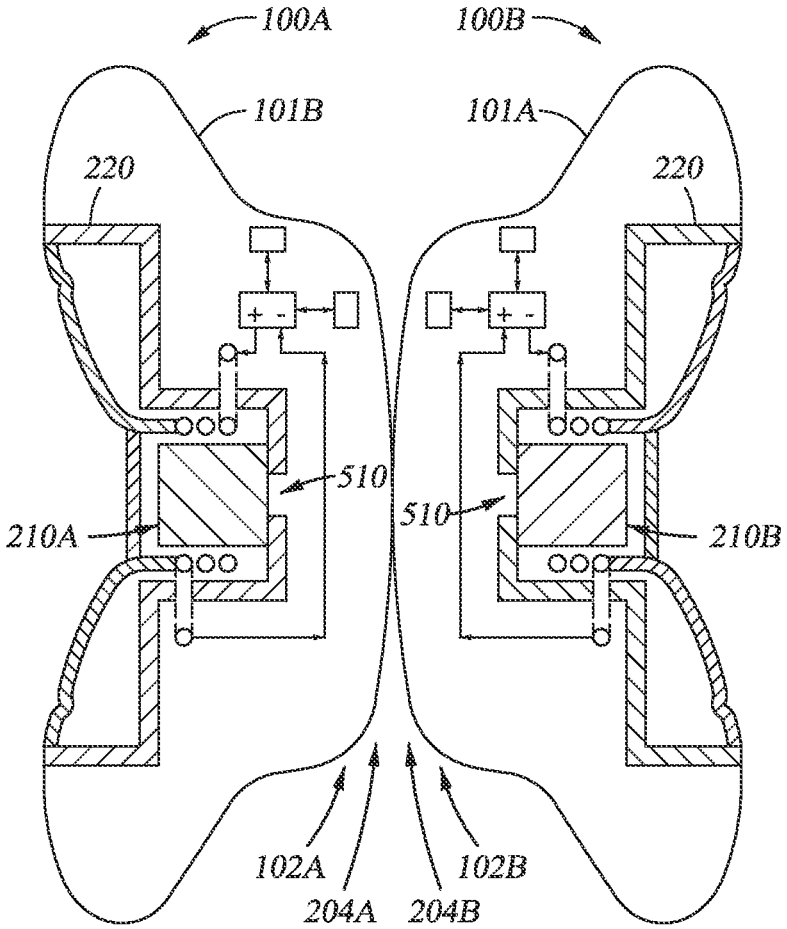
FIG. 5 is a schematic cross-sectional view of audio components in a wireless headphone system according to one embodiment of the present disclosure.

FIG. 2A is a schematic side cross-sectional view of the first and second audio components 100A, 100B according to an embodiment of the invention. Each of the audio components 100A, 100B may include a body 201A, 201B, speaker 230A, 230B, speaker driver assembly 232, a transceiver 234 and a battery 236. Each body 201A, 201B may include a front surface 203A, 203B, a rear surface 204A, 204B and a mating surface 102A, 102B, respectively. In some examples, as illustrated in FIGS. 4 and 5, the mating surfaces 102A, 102B may coincide with the front surfaces 203A, 203B (FIG. 4) or the rear surface 204A, 204B (FIG. 5).

Alternately, in some embodiments, the first and second audio components 100A, 100B may each include a body 201 and a speaker 230, and only one of the two audio components 100A, 100B additionally contains the speaker driver assembly 232, transceiver 234 and/or the battery 236 that are shared by both of the audio components 100A, 100B. To allow one or more of these sub-components to be shared, the audio components 100A, 100B may be wired together via the connecting element 103. In some embodiments, a single battery 236 is used to power both of the audio components 100A, 100B. In some configurations, the single battery may be disposed in one of the audio components 100A, 100B, in the connecting element 103 or in some other external position.

Figure 2B:
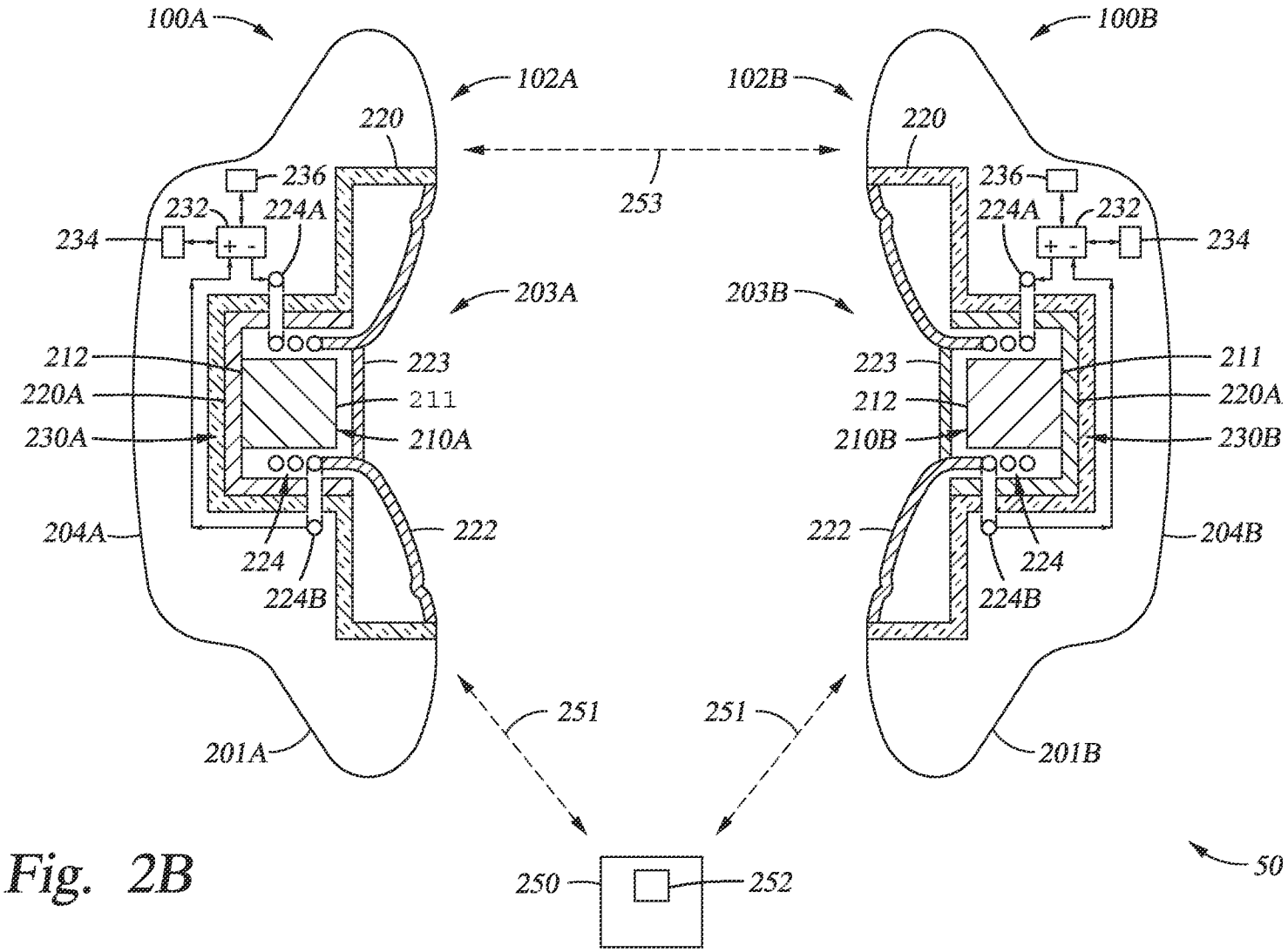
FIG. 2B is a schematic cross-sectional view of audio components in a wireless headphone system according to one embodiment of the present disclosure.

The transceiver 234 is used to receive audio signals from an audio source 250 through a wireless communication link 251 and render an acoustic output to the user 10 (FIGS. 1A-1B) without requesting the user to be physically connected to the audio source 250. The audio source 250 may be any electronic device capable of transmitting an audio signal by wireless communication. The audio source 250 may be a video game console, a personal computer, a tablet computer, a laptop computer, a digital music player, a cell phone (e.g., a smart phone), an stereo system, a television, a video player (e.g., a DVD player, a Blu-ray player), a radio, or other similar device. The audio source 250 may include one or more transceivers 252 configured to establish one or more different types of wireless communication links with the transceiver 234. A transceiver 234 and transceiver 252 may be configured to establish a Wi-Fi communication link, a BLUETOOTH® communication link, Avnera Audio Link (AAL) or near field communication (NFC) link, or other types of communication link so that audio and other useful data can be transferred therebetween. However, in some embodiments, the audio source 250 is only required to communicate with a transceiver 234 in the first audio component 100A, which then relays the received information to a transceiver 234 in the second audio components 100B, or vice versa, using a communication link 253 (FIG. 2B).

The speaker driver assembly 232 in each of the audio components 100A and 100B may include a processing unit that is configured to receive signals from the transceiver 234 and transfer audio data (e.g., audio output information) to the speaker 230A, 230B. In one embodiment, the audio components 100A, 100B, are configured to primarily deliver the audio data to a user that is positioned adjacent to the front surface 203A, 203B by use of the speakers 230A, 230B. The processing unit may be a hardware unit or combination of hardware units capable of executing software instructions and processing data. For example, the processing unit may be a central processing unit (CPU), a digital signal processor (DSP), an application-specific integrated circuit (ASIC), a combination of such units, and so forth. The speaker driver assembly 232 also contains one or more components that are configured to drive the speaker 230A, 230B so that the audio signal received from the transceiver 234 can be delivered to the user through the speaker 230A, 230B. The speaker driver assembly 232 may include a memory unit (not shown) that is coupled to the processing unit. The memory unit may include any technically feasible type of hardware unit configured to store data, such as a hard disk, a RAM module, a flash memory unit, or a combination of hardware units for storing data. The speaker driver assembly 232 may also further include software application (not shown) within the memory unit. The software application may include program codes that may be executed by the processing unit to perform various functionalities associated with the audio components 100A, 100B. In one configuration, the software applications are configured to adjust one or more of the activities performed by the audio components based on information received by one or more sensors (e.g., switches) or the transceiver 234. The activities may include, but are not limited to, turning on or off the audio component, putting the audio component in a "sleep" mode, adjusting the audio output parameters (e.g., volume, EQ settings, etc.) or other useful activities.

The speakers 230A and 230B each include a primary magnet 210A, 210B and a coil 224 that are configured to cooperatively drive a membrane 222 and dust cover 223, which are coupled to coil 224, based on an audio signal inductively provided to the primary magnet 210A, 210B by the coil 224 based on a signal sent from the speaker driver assembly 232. The speakers 230A and 230B may also each include a frame element 220 that is configured to retain the magnetic fields generated by the primary magnet 210A, 210B. In one configuration, the frame element 220 may include a conductive material, such as a steel, aluminum, other type of metal or conductive plastic. In another configuration, the frame element 220 may include a plastic material. In this configuration, the frame element 220 may further include a ferrous structure 220A that surrounds the outer diameter of the coil 224, and thus the coil 224 is disposed between the inner diameter of the ferrous structure 220A and the outer diameter of the magnet 210A, 210B, as shown in FIG. 2B. The ferrous structure 220A, which may include a ferrous material (e.g., ferromagnetic material), can be used to concentrate the magnetic fields generated by the primary magnet 210A, 210B for proper operation of the speaker driver assembly 232.

In one embodiment, the wireless headphone system 50 includes speakers 230A and 230B that are configured so that the opposing mating surface 102A and 102B of the audio components 100A, 100B can be brought into contact with each other due to the orientation of the magnetic components, such as the primary magnet 210A and 210B, in the speakers 230A and 230B. In this configuration the magnetic poles of the primary magnets are oriented in an opposite magnetic orientation, thus allowing the like faces of the audio components 100A, 1008 to be brought together. For example, the first audio component 100A includes a primary magnet 210A that is oriented with its south pole 212 positioned closer to its frame element 220 and its north pole 211 facing away from the frame element 220, while the of the second audio component 100B includes a primary magnet 210B that is oriented with its north pole 211 closer to its frame element 220 and its south pole 212 is facing away from the frame element 220. Therefore, the first second audio component 100A and second audio component 100B will be attracted to each other due to the north pole 211 of the first audio component 100A being attracted to the south pole 212 of the second audio component 1008. One will note that the complementary magnetic pole orientation configuration of the primary magnets described herein is different than conventional headphone designs that have the magnetic poles in each audio component oriented in the same direction (e.g., both audio components have north poles 211 that face away from the frame element 220). Therefore, in conventional headphone designs it is not possible to bring the mating surfaces 102A, 102B together, since the opposing magnetic poles in the conventional design will repel each other and prevent the mating surfaces from being brought together.

However, in order to deliver audio content from both audio components 100A and 1008, the speaker driver assembly 232 in the audio component 100A needs to oppositely drive its coil 224 versus the direction that the speaker driver assembly 232 in the audio components 1008 drives its coil 224, due to the difference in the orientation of the primary magnets 210A and 2108. In other words, the lead 224B in the coil 224 in the first audio component 100A is configured to receive a current from the speaker driver assembly 232 and the lead 224A is configured to return the received current back to the speaker driver assembly 232 to close the inductive loop, while the lead 224A in the coil 224 in the second audio component 1008 is configured to receive a current from the speaker driver assembly 232 and the lead 224B is configured to return the received current back to the speaker driver assembly 232 to close the inductive loop.

Figure 3:
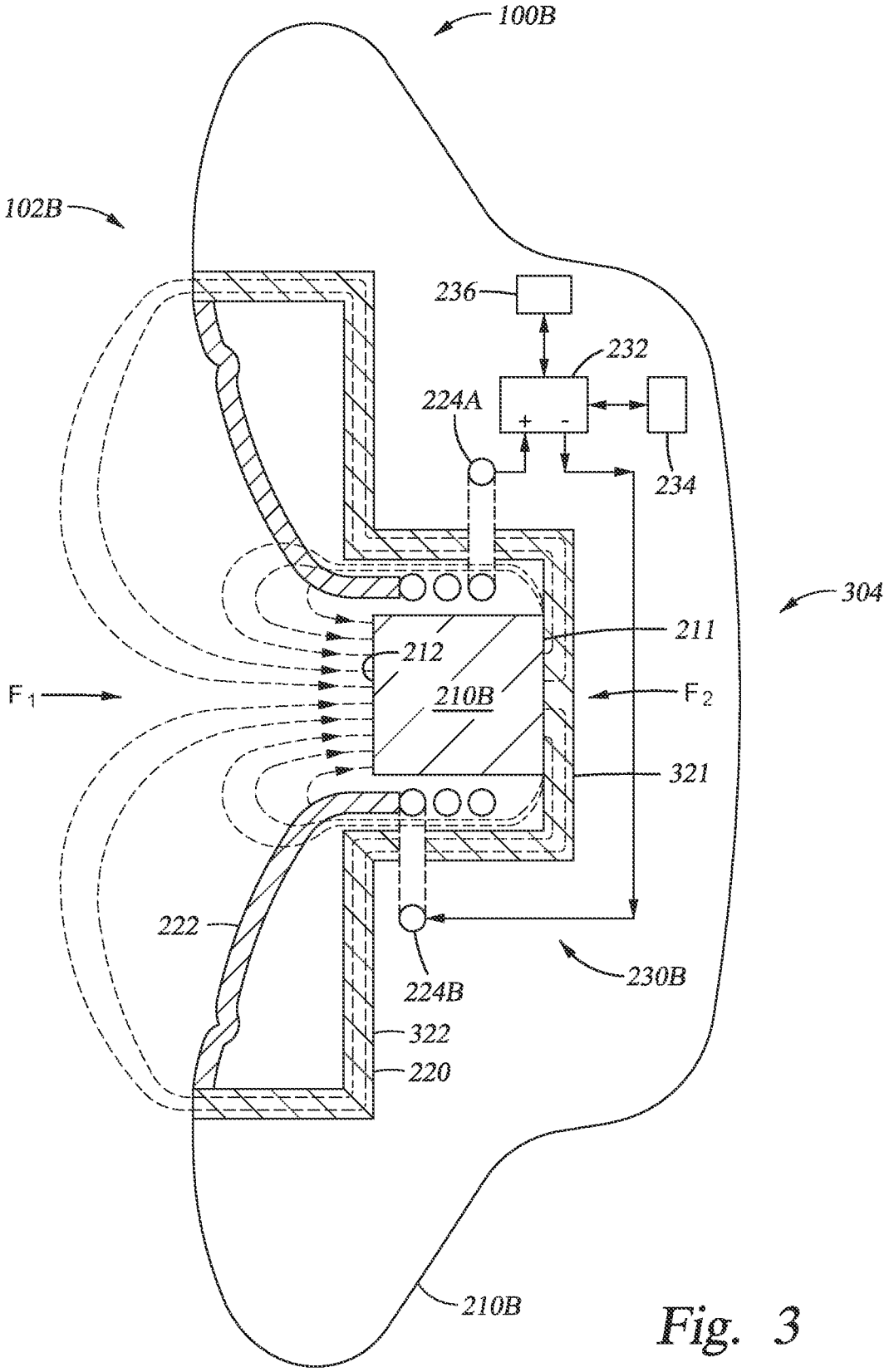
FIG. 3 is a schematic cross-sectional view of an audio component in a wireless headphone system according to one embodiment of the present disclosure.
Figure 7:
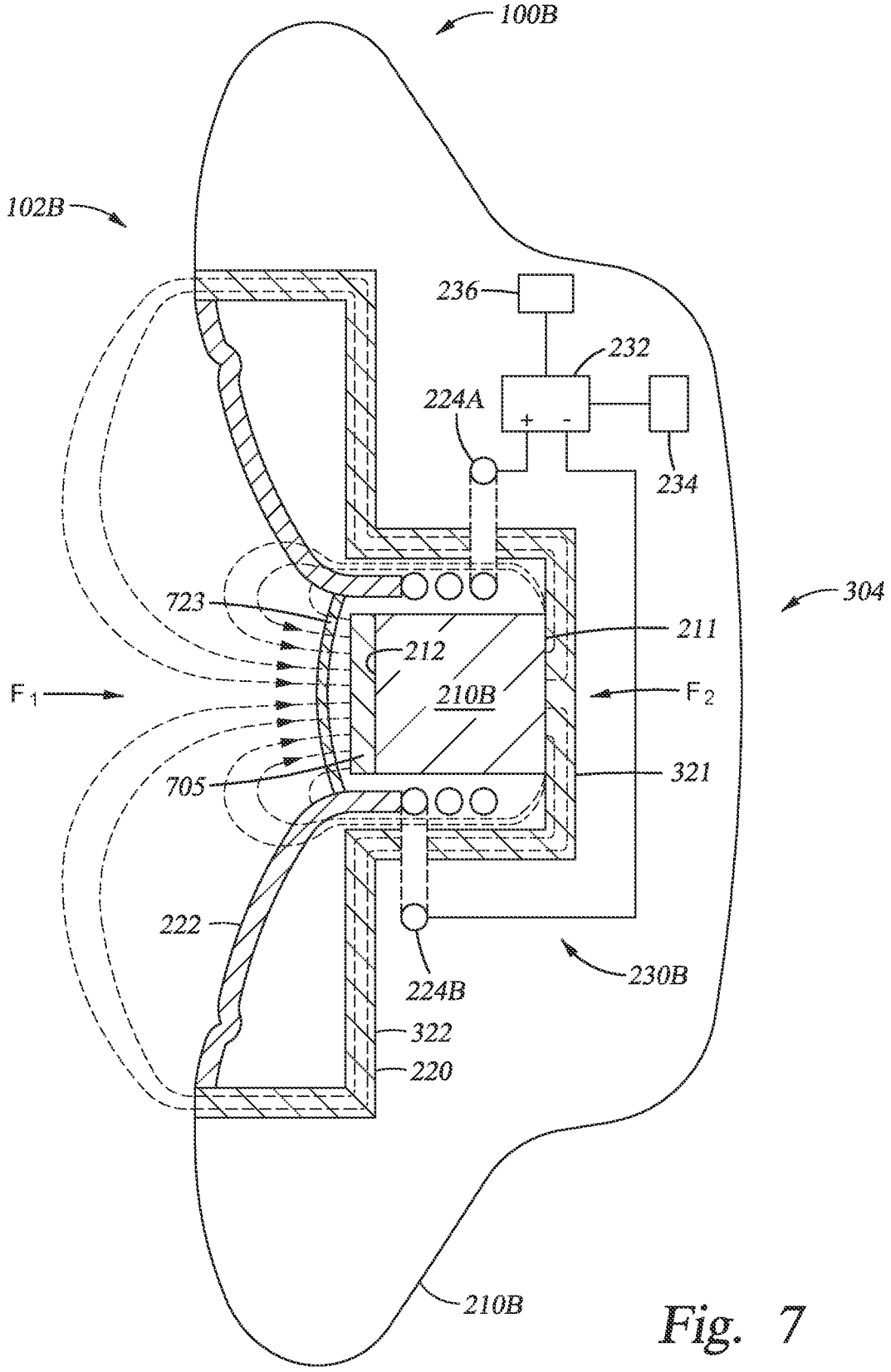
FIG. 7 is a schematic cross-sectional view of an audio component in a wireless headphone system according to one embodiment of the present disclosure.

FIG. 3 is a schematic side cross-sectional view of the second audio components 100B according to an embodiment of the invention. For clarity of illustration and discussion reasons the optional dust cover 223 has been removed from FIG. 3. As schematically illustrated in FIG. 3, magnetic field lines F1 and F2 generated by the presence of the primary magnet 210B in the speaker 230B extend outside of the body 304 (FIGS. 3 and 7). These generated magnetic field lines by each of the audio components 100A, 100B are used to bring and retain the audio components 100A, 100B together when they are not in use by the user. One will note that a magnetic field having an oppositely oriented magnetic field is also generated by the audio component 100A (not shown in FIG. 3) so that the audio components 100A and 100B can be brought together.

In some configurations, a frame element 220 is contained within a speaker assembly, such as the second audio component 100B illustrated in FIG. 3. The frame element 220 is used to shield and/or gather the generated magnetic fields provided by the primary magnet 210B so that the magnetic field lines can be to be brought to a region at or proximate to the mating surface 102B to increase the ability of the audio components 100A, 100B to be brought together (see FIG. 1B) when they are initially positioned a distance apart (see FIG. 1A).

FIG. 4 is a schematic side cross-sectional view of the first and second audio components 100A, 100B that have been brought together due to the complementary magnetic pole configuration described above. In this case the complementary generated magnetic fields that extend from the mating faces 102A and 102B (e.g., magnetic field F1 in FIG. 3) causes the mating surfaces 102A and 102B of the audio components 100A, 100B, respectively, to be brought into contact with each other due to their complementary attraction. The complementary attraction of the oppositely oriented primary magnets thus creates a holding force between the contacting mating surfaces 102A and 102B.

FIG. 5 is a schematic side cross-sectional view of the first and second audio components 100A, 100B that have also been brought together due to the complementary magnetic pole configuration described above. In this case the complementary generated magnetic fields that extend from the rear surfaces 204A and 204B causes the rear surfaces 204A and 204B of the audio components 100A, 100B, respectively, to be brought into contact with each other due to their complementary attraction. In one configuration, the frame element 220 may include one or more breaks and/or holes 510 that allow the magnetic field lines (e.g., field lines F2) to extend outside of the rear surfaces 204A and 204B to create an attraction between the audio components 100A, 100B.

In some embodiments, the shape of the bodies 101A and 101B are tailored to allow desirable mating surfaces of the audio component 100A and 100B to be brought together and held by the complementary magnetic pole orientation configuration. In some cases, each body 101A, 101B may contain a notch or other feature that allows the audio components 100A, 100B to be aligned and/or brought together in a desired configuration. In some configurations, it is desirable to configure the mating surfaces 102A, 102B so that they cover and/or protect the audio delivering regions of the audio components 100A, 100B, such as the front surface 203A, 203B shown in FIG. 2A. In some configurations, it is desirable to configure the mating surfaces 102A, 102B so that they allow the audio components 100A, 100B to be easily stored.

Figure 6:
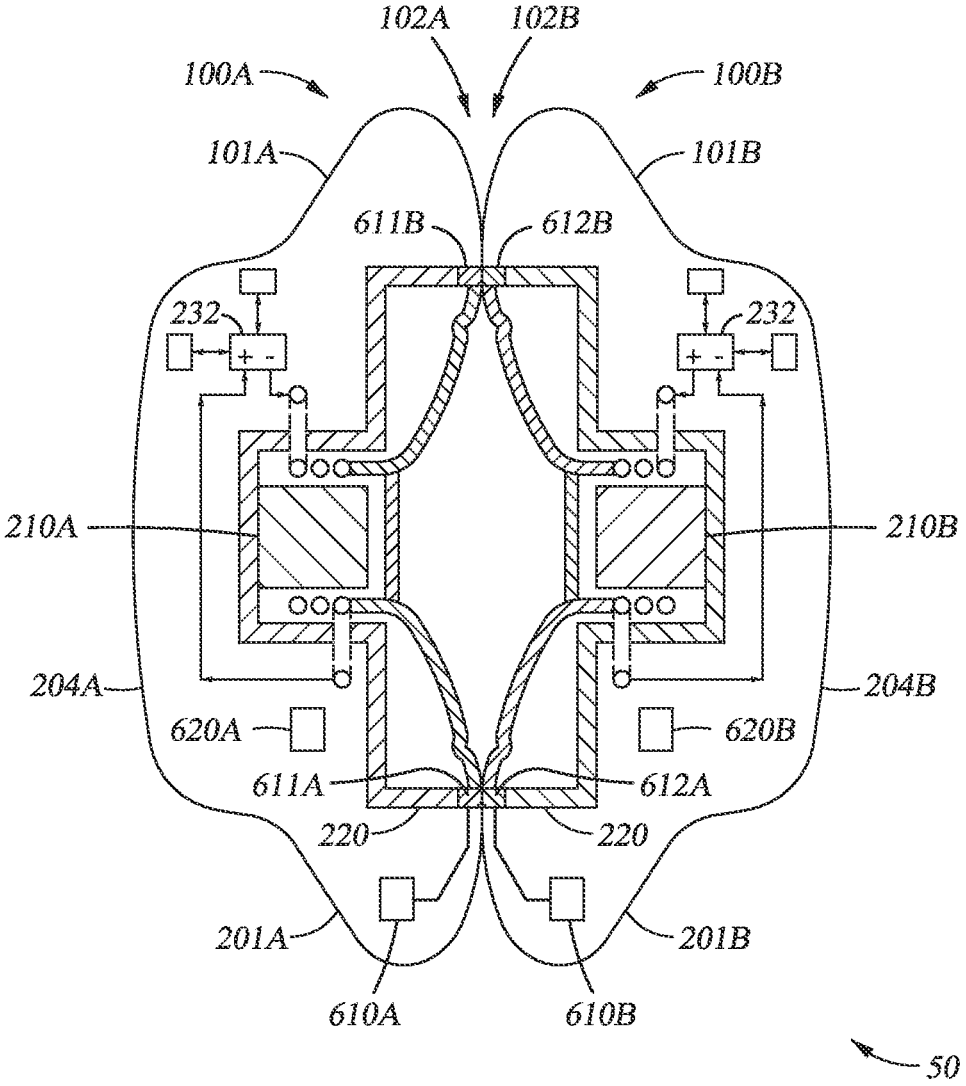
FIG. 6 is a schematic cross-sectional view of audio components in a wireless headphone system according to one embodiment of the present disclosure.

FIG. 6 is a schematic side cross-sectional view of the first and second audio components 100A, 100B according to an embodiment of the invention. In one embodiment, the wireless headphone system 50 may include audio components 100A, 100B that each contain one or more devices that are configured to actively shutoff or cause the audio components 100A, 100B to got into a "sleep" mode when they are brought together due to the complementary magnetic pole configuration described above. In one embodiment, the first audio component 100A includes a switching device 610A that is coupled to metallic contacts 611A and 611B that are electrically shorted together when a conductive structure (not shown) on the second audio component 100B is brought into contact with the metallic contacts 611A and 611B. Similarly, the second audio component 100B may also similarly includes a switching device 610B that is coupled to metallic contacts 612A and 612B that are electrically shorted together when a conductive structure (not shown) on the first audio component 100A is brought into contact with the metallic contacts 612A and 612B. In this case, the switching devices 610A and 610B in each of the audio components 100A and 100B can each be configured to cause its respective speaker driver assembly 232 to suspend the delivery of an audio signal to the speaker 230, shutdown any non-essential components to reduce unnecessary power usage and/or shut off the audio component 100A, 100B. In some configurations, the generation of the first acoustic output from the speaker 230 is completed while the audio components 100A and 100B are receiving wireless communication signal from an audio source 250.

In some embodiments, one or more of the switching devices 610A and 610B are able to generate a signal that is used by the speaker driver assembly 232 to deliver a playback delivery status signal to an audio source 250, such as a phone or portable music player, letting it know that the audio components 100A and 100B are no longer in use, so that the audio playback delivered from the audio device can be suspended (e.g., halted, stopped or paused for a period of time) or the audio components 100A and 100B can be shut off. In one example, one or more of the switching devices 610A and 610B are coupled to the microphone leads of a headset that is in communication with the audio source 250, and thus is able to send the playback delivery status signal to the audio source 250 letting it know that the audio components 100A and 100B are no longer in use.

In one embodiment, the wireless headphone system 50 may include audio components 100A, 100B that each contain one or more reed switches 620A, 620B that detect the presence of the primary magnet in an opposing audio device. The reed switches 620 can then be used to suspend the delivery of an audio signal to the speaker 230 and/or shutdown any other unnecessary power usage in the other non-essential audio components.

FIG. 7 is a schematic side cross-sectional view of the second audio components 100B according to an embodiment of the disclosure. In one embodiment, the wireless headphone system 50 may include audio components 100A, 100B that each contain a magnetic extension 705 of a primary magnet to enhance and/or allows the magnetic fields generated by the primary magnet to extend a greater distance from the body 101A, 101B of one or more of the audio components 100A, 100B. In one example, as illustrated in FIG. 7, the audio components 100B includes a magnetic extension 705 that is magnetically coupled to the south pole 212 of the primary magnet 210B. In this configuration, the audio component 100A (not shown) may also include a magnetic extension 705 that is magnetically coupled to the north pole 211 of the primary magnet 210A. In general, the magnetic extension 705 may comprise a metal or metal alloy that is able to transmit the magnetic fields generated by the primary magnet, such as a ferromagnetic material.

In some embodiments, a dust cover 710 may be positioned over the primary magnet and magnetic extension 705 to prevent dust or other matter from affecting the internal components of the wireless headphone system 50.

While the discussion provided above primarily discusses a complementary magnetic pole configuration that is used in conjunction with a wireless headphone system, this configuration is not intended to be limiting as to the scope of the disclosure provided herein, since the hardware configurations and methods described herein could also be used to solve similar problems found in a wireless speaker system. In one example, by altering one or more of the primary magnet configurations in one or more of the speakers in two or more complementary configured wireless speakers the devices could be held together by the magnetic attraction of the primary magnets to allow their easy storage or provide an input that the speakers are no longer in use and thus can be shutdown or placed in a "sleep" mode to preserve power in the batteries.

The disclosure has been described above with reference to specific embodiments. Various embodiments may be used in alone or in combination. Persons skilled in the art, however, will understand that various modifications and changes may be made thereto without departing from the broader spirit and scope of the disclosure as set forth in the appended claims. The foregoing description and drawings are, accordingly, to be regarded in an illustrative rather than a restrictive sense.

The invention claimed is:

1. An audio device, comprising:

a first audio component capable of generating a first acoustic output from signals received through a first communication link, wherein the first audio component comprises a first mating surface, a first coil, a switch, and a first primary magnet that has a north pole and a south pole that are oriented in a first orientation relative to the first mating surface, the first coil and the first primary magnet are configured to cooperatively generate the first acoustic output, the first mating surface includes a first electrical contact and a second electrical contact, the first electrical contact connected to the switch, the first audio component further comprises a first frame element that has a surface that is in contact with the north pole of the first primary magnet, and the first frame element further comprises a hole that is positioned to allow a magnetic field generated by the first primary magnet to reach a side that is opposite to the surface that is in contact with the north pole; and a second audio component capable of generating a second acoustic output from signals received through the first communication link or a second communication link, wherein the second audio component comprises a second mating surface, a second coil, and a second primary magnet that has a north pole and a south pole that are oriented in a second orientation relative to the second mating surface, the second orientation is opposite to the first orientation, the second audio component further comprises a second frame element that has a surface that is in contact with the south pole of the second primary magnet, the second frame element further comprises a hole that is positioned to allow a magnetic field generated by the second primary magnet to reach a side that is opposite to the surface that is in contact with the south pole, and the second coil and the second primary magnet are configured to cooperatively generate the second acoustic output, and wherein the first and the second mating surfaces are attracted to each other, when they are positioned proximate to and face each other, based on the opposite orientation of the first primary magnet to the second primary magnet, the second mating surface is configured to electrically connect the first electrical contact of the first mating surface with the second electrical contact of the first mating surface to change a state of the switch; and the first and the second mating surfaces both coincide with a correspondingly configured surface formed on the first and the second audio components.

2. The audio device of claim 1, wherein the switch is configured to allow or suspend the generation of the first acoustic output by the first audio component.

3. The audio device of claim 1, wherein the switch is further configured to cause a speaker driver assembly to allow or suspend the generation of the first acoustic output by the first audio component.

4. The audio device of claim 1, wherein the first audio component or the second audio component further each comprise a transceiver that is configured to receive a wireless communication signal via the first communication link.

5. The audio device of claim 1, wherein at least a portion of the first frame element is disposed proximate to the first mating surface, and at least a portion of the second frame element is disposed proximate to the second mating surface.

6. The audio device of claim 1, wherein the first audio component further comprises a ferrous structure that is disposed between the north pole of the first primary magnet and the first frame element, and the second audio component further comprises a ferrous structure that is disposed between the south pole of the second primary magnet and the second frame element.

7. The audio device of claim 1, wherein the first audio component further comprises:

a first speaker driver assembly; and a first speaker, wherein the first coil has a first end and a second end, and a positive terminal of the first speaker driver assembly is connected to the first end of the first coil, and the second audio component further comprises:

a second speaker driver assembly; and a second speaker, wherein the second coil has a first end and a second end, and a positive terminal of the second speaker driver assembly is connected to the second end of the second coil to oppositely drive the second coil versus the orientation that the first speaker driver drives the first coil.

8. The audio device of claim 1, further comprising a connecting element that is coupled to the first audio component and the second audio component, wherein the first audio component and the second audio component are configured to be positioned within a portion of an ear of a user.

9. The audio device of claim 1, wherein the first audio component and the second audio component each further comprise:

a battery; and a speaker driver assembly that is powered by the battery.

10. The audio device of claim 1, wherein the first audio component further comprises a magnet extension element that is position on the south pole of the first primary magnet, the second audio component further comprises a magnet extension element that is position on the north pole of the second primary magnet, the magnet extensions comprise a ferromagnetic material.

11. A method of generating an acoustic output from an audio device, comprising:

generating a first acoustic output from a first speaker disposed in a first audio component, wherein the first audio component comprises a first surface and a switch, the first surface including a first electrical contact and a second electrical contact, the first electrical contact connected to the switch, the first speaker comprises a first coil and a first primary magnet that has a north pole and a south pole that are oriented in a first orientation relative to the first surface, the first coil and the first primary magnet are configured to cooperatively generate the first acoustic output, the first audio component further comprises a first frame element that has a surface that is in contact with the north pole of the first primary magnet, and the first frame element further comprises a hole that is positioned to allow a magnetic field generated by the first primary magnet to reach a side that is opposite to the surface that is in contact with the north pole;

generating a second acoustic output from a second speaker disposed in a second audio component, wherein the second audio component comprises a second surface configured to electrically connect the first electrical contact of the first surface with the second electrical contact of the first surface to change a state of the switch, the second speaker comprises a second coil and a second primary magnet that has a north pole and a south pole that are oriented in a second orientation relative to the second surface, and the second orientation is opposite to the first orientation, the second audio component further comprises a second frame element that has a surface that is in contact with the south pole of the second primary magnet, the second frame element further comprises a hole that is positioned to allow a magnetic field generated by the second primary magnet to reach a side that is opposite to the surface that is in contact with the south pole, and the second coil and the second primary magnet are configured to cooperatively generate the second acoustic output; and generating a holding force between the first surface of the first audio component and the second surface of the second audio component due to an attraction provided by the first primary magnet and the second primary magnet, and based on the orientation of the first primary magnet to the first surface and the orientation of the second primary magnet to the second surface, wherein the first and the second surfaces both coincide with a correspondingly configured surface formed on the first and the second audio components.

12. The method of claim 11, further comprising:

suspending the generation of the first acoustic output or the second acoustic output when the holding force is generated.

13. The method of claim 11, wherein the generating the first acoustic output comprises delivering a first current through the first coil in the first speaker in a direction that is opposite to a direction that a second current is delivered through a second coil in the second speaker when it is generating the second acoustic output.

14. The method of claim 11, wherein generating the first acoustic output and the generating the second acoustic output each further comprise:

receiving a wireless communication signal from an audio source, wherein the wireless communication signal comprises audio data.

15. The method of claim 14, further comprising:

suspending the generation of the first acoustic output or the second acoustic output when the holding force is generated and while receiving the wireless communication signal.

16. The method of claim 11, wherein generating the first acoustic output and the generating the second acoustic output each further comprises receiving a wireless communication signal from an audio source, and the method further comprises:

suspending the generation of the first acoustic output or the second acoustic output when the holding force is generated; and transmitting a status signal to the audio source, wherein the status signal is configured to cause the audio source to suspend the delivery of the wireless communication signal.

17. The audio device of claim 1, wherein the correspondingly configured surface of the first and the second audio components is a front surface, and the front surface of the first and the second audio components each include a speaker.

18. The method of claim 11, wherein the generated holding force causes a first audio delivering region in the first audio component and a second audio delivering region in the second audio component to become aligned.

19. The method of claim 11, wherein the correspondingly configured surface of the first and the second audio components is a front surface, and the front surface of the first and the second audio components each include a speaker.

20. The audio device of claim 1, wherein the first frame element is disposed around the first primary magnet, the first frame element includes a first portion electrically connected with the first electrical contact and with the switch, and the first frame element includes a second portion electrically connected with the second electrical contact.

21. The audio device of claim 20, wherein the first portion of the first frame element is electrically connected with a first terminal of a power source, the second portion of the first frame element is electrically connected with a second terminal of the power source, and the first terminal has an opposite polarity relative to the second terminal.

* * * * *